United States Patent [19]

Henderson

[11] 3,936,220

[45] Feb. 3, 1976

[54] JACKET CONSTRUCTION FOR FLUID-CIRCULATING PUMPS

[75] Inventor: James R. Henderson, Charlotte, N.C.

[73] Assignee: Controls Southeast, Inc., Charlotte, N.C.

[22] Filed: Aug. 26, 1974

[21] Appl. No.: 500,745

[52] U.S. Cl. ..... 415/178

[51] Int. Cl.² ..... F01D 5/08

[58] Field of Search ..... 415/178; 425/378, 381.2; 259/191, 192, 193

[56] References Cited

UNITED STATES PATENTS

| | | | |
|---|---|---|---|
| 2,341,664 | 2/1944 | Schutte | 415/178 |
| 2,713,188 | 7/1955 | Garvey | 425/378 |
| 2,801,821 | 8/1957 | Burger | 415/178 |

FOREIGN PATENTS OR APPLICATIONS

| | | | |
|---|---|---|---|
| 516,511 | 1/1931 | Germany | 415/178 |
| 733,048 | 3/1943 | Germany | 415/178 |
| 952,171 | 11/1956 | Germany | 415/178 |
| 337,331 | 10/1930 | United Kingdom | 415/178 |

*Primary Examiner*—Henry F. Raduazo
*Attorney, Agent, or Firm*—Parrott, Bell, Seltzer, Park & Gibson

[57] ABSTRACT

To aid in maintaining at a desired temperature a fluid being propelled through a fluid-circulating pump, a jacket means is provided which has a hollow housing of heat-conductive material substantially surrounding the body of the pump and through which a temperature controlling fluid is circulated in heat-transferring relation to the body of the pump.

19 Claims, 17 Drawing Figures

JACKET CONSTRUCTION FOR FLUID-CIRCULATING PUMPS

This invention relates to pumps for fluid conveying systems for hot and cold fluids, and more especially to an improved jacket construction substantially surrounding a fluid-circulating pump in heat-transferring relation thereto and through which a temperature controlling fluid is circulated to aid in maintaining the pump and the fluid being pumped therethrough at a desired optimum temperature.

Various forms of specially constructed pumps have been made heretofore for permitting circulation of a temperature controlling fluid, such as water, internally of the body of the pump. For example, Singer U.S. Pat. No. 664,507 dated Dec. 25, 1900, and Levey U.S. Pat. No. 977,662, dated Dec. 6, 1910, are typical of prior art illustrating such types of specially constructed pumps. It is apparent that such specially constructed pumps are quite expensive.

Therefore, it has been the customary practice to weld a wall to the body of a conventional pump so as to form a jacket defining a passageway between the welded wall and the pump body to permit circulating a temperature controlling fluid therethrough in heat-transferring relation to the pump body. However, this prior practice has many disadvantages. Of primary importance is the fact that substantial areas of the body of the pump are exposed and are not in heat-transferring relation to the circulating temperature controlling fluid. Such exposure of substantial portions of the pump body is necessary due to the difficulties in welding a wall thereon and the need for having substantial areas exposed in effecting the weld thereto. Also, the attendant cost in welding such a wall around the pump body is expensive, bearing in mind that the usual irregular exterior configuration of a pump body is such that the welded wall must be of a multi-piece construction so as to be positioned in the desired close relationship to the pump body for forming a relatively small passageway therebetween through which steam or other temperature controlling fluid is to be circulated.

Another disadvantage of this prior practice of forming a jacket around a pump body is that the attendant welding can only be effected on the exterior surfaces of the jacket so that the welded seams are not as strong as would be the case if the joints were welded from both sides. Thus, these exteriorly welded seams are susceptible of rupture under the high internal pressures and temperatures to which such jackets are generally subjected. In this regard, for example, in the conveyance of a number of chemical materials, such as in the formation or production of synthetic textile fibers, it is not uncommon to utilize steam at a pressure of 100 to 150 pounds per square inch and at a temperature up to 375° Fahrenheit in order to prevent undesirable heat loss and interference with the flow of the material. Thus, it is important that the steam jacket surrounding the pump be capable of withstanding high internal pressure to avoid sudden undesirable pressure and temperature changes in the steam and also to avoid possible injury to persons in the vicinity of the jacketed pump in the event that the jacket should rupture.

It is therefore an object of this invention to provide an improved, simple, effective and economical jacket construction for fluid-circulating pumps, which jacket construction avoids problems encountered with the prior art, and wherein the improved jacket construction may be readily mounted on existing pumps without altering the construction of the pump or the fluid conveying system in which the pump is installed. Also, the improved jacket construction obviates the need for welding any portions thereof to the pump.

It is a more specific object of this invention to provide an improved jacket construction substantially surrounding the body of a fluid-circulating pump and positioned in heat-transferring relation to the pump body for directing a temperature controlling fluid into heat-transferring relation thereto, and wherein the jacket construction comprises a housing of heat-conductive material which includes inner and outer walls having therebetween at least one fluid passageway provided with inlet and outlet ports for circulation of the temperature controlling fluid through the passageway.

It is another more specific object of this invention to provide a jacket construction of the type described and comprising a housing which may take the form of a single integral block of heat-conductive material or which may be in the form of a cooperating pair of blocks of heat-conductive material depending, in some instances, upon the configuration of the pump body, and wherein the blocks are molded or cast with each of the blocks including inner and outer walls having a fluid passageway there-between provided with inlet and outlet ports for circulation of a temperature controlling fluid therethrough, and also wherein means are provided for detachably securing the single block or the pair of blocks, as the case may be, in substantially surrounding relation to the pump body.

Some of the objects of the invention having been stated, other objects will appear as the description proceeds when taken in connection with the accompanying drawings, in which --

FIG. 1 is a perspective view of a first embodiment of the improved jacket construction in heat-transferring relation to the volute body of a fluid-circulating centrifugal pump omitting any insulation material and showing drive means for the pump in broken lines;

FIG. 2 is an enlarged perspective view of the cooperating pair of blocks of the first embodiment of the jacket construction shown in FIG. 1, but wherein the blocks are shown in exploded relationship and in broken lines to illustrate respective hollow shell-like members or radiators defining the fluid passageways in the blocks, with the hollow members being shown in solid lines and with one of them being shown partially broken away;

Figure 7:
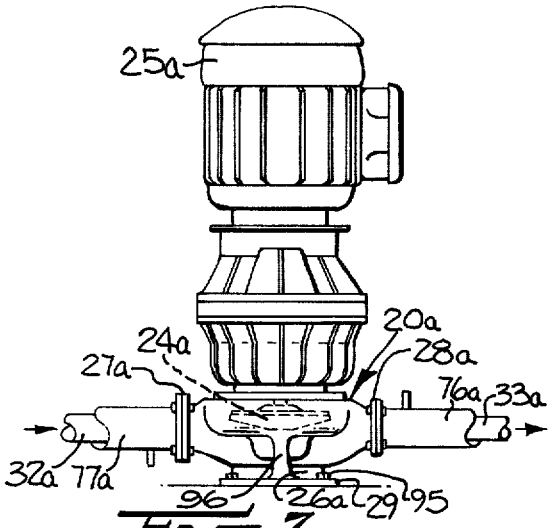
FIG. 7 is a side elevation of a different type of fluid-circulating pump from that shown in association with the first embodiment of the invention of FIGS. 1–6, the pump in FIG. 7 being of an in-line, pedestal mounted type with a rotary impeller means therein mounted on a vertical axis and a drive means for the impeller means supported upon the pump body.
Figure 13:
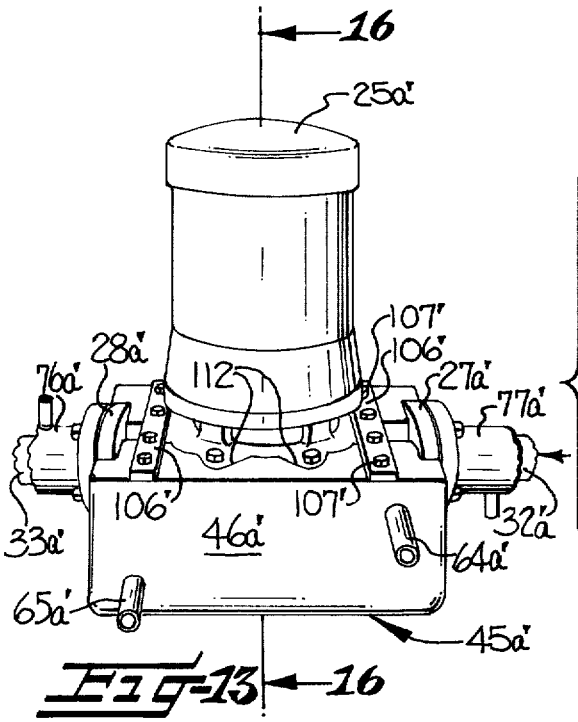
Figure 14:
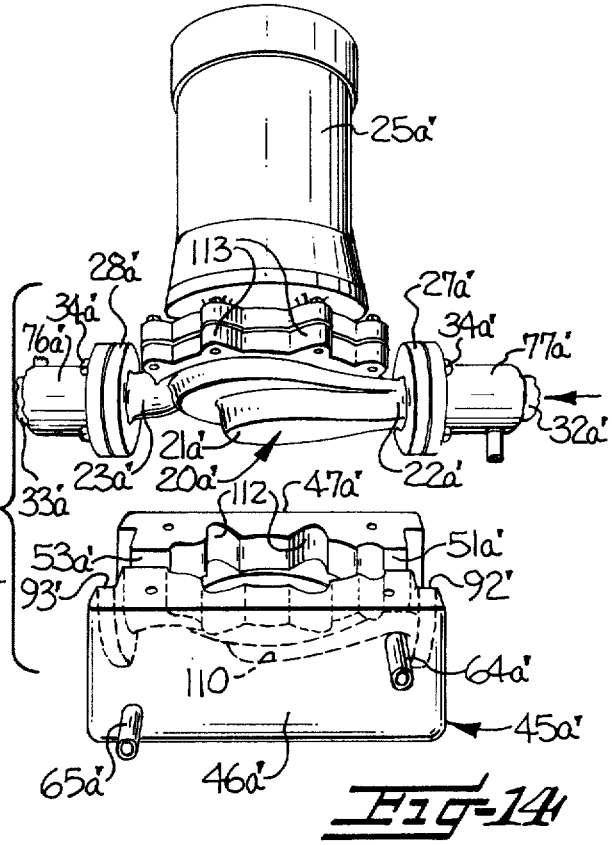
Figure 15:
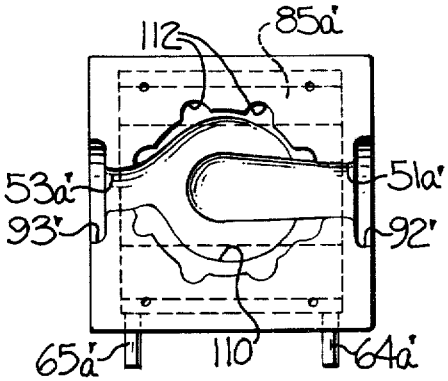
Figure 16:
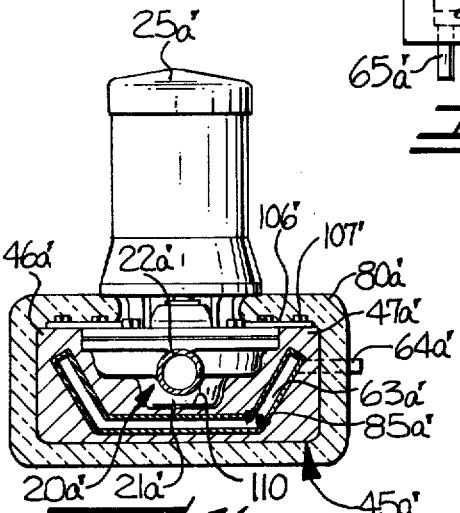
Figure 17:
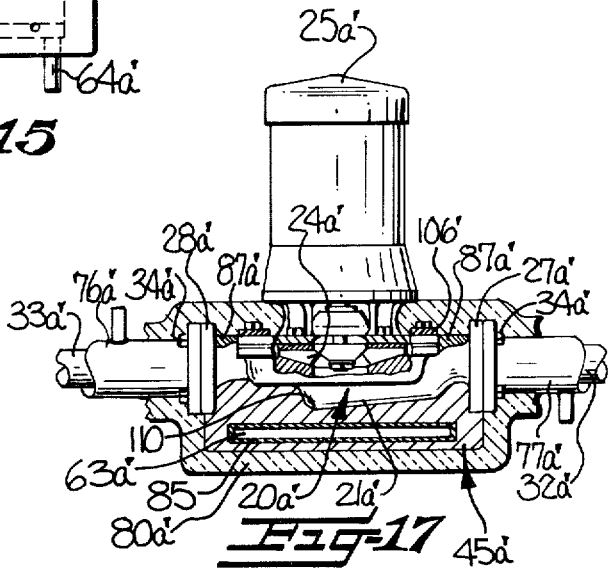

FIG. 13 is a perspective view of a third embodiment of the invention in association with a fluid-circulating pump which also is of the in-line type similar to FIG. 7, but wherein the pump is adapted to be suspended between connecting conduits or pipes and does not have a pedestal or bottom flange thereon so that the jacket construction in association therewith takes the form of a single integral jacket block of substantially U-shaped cross-sectional configuration;

FIG. 14 is a partially exploded perspective view showing the jacket block and the associated pump in spaced relationship for purposes of illustration;

FIG. 15 is a plan view of the jacket block of FIGS. 13 and 14 but showing the same on a reduced scale removed from the pump body;

FIG. 16 is a transverse vertical sectional view taken substantially along line 16—16 in FIG. 13 and showing the jacket construction on a reduced scale surrounded by an insulation material which is omitted in FIGS. 13 and 14; and FIG. 17 is a longitudinal vertical sectional view through the jacket block of FIGS. 13–16 and with the pump therein partially broken away to illustrate the rotary impeller means therein.

Figure 2:
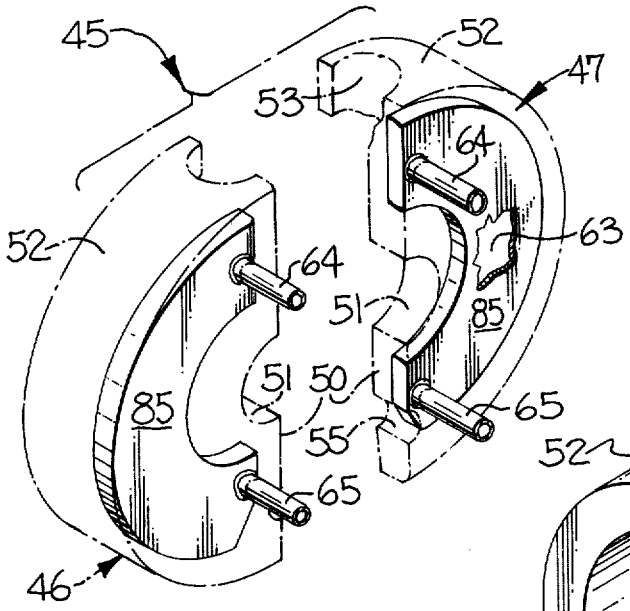
Figure 3:
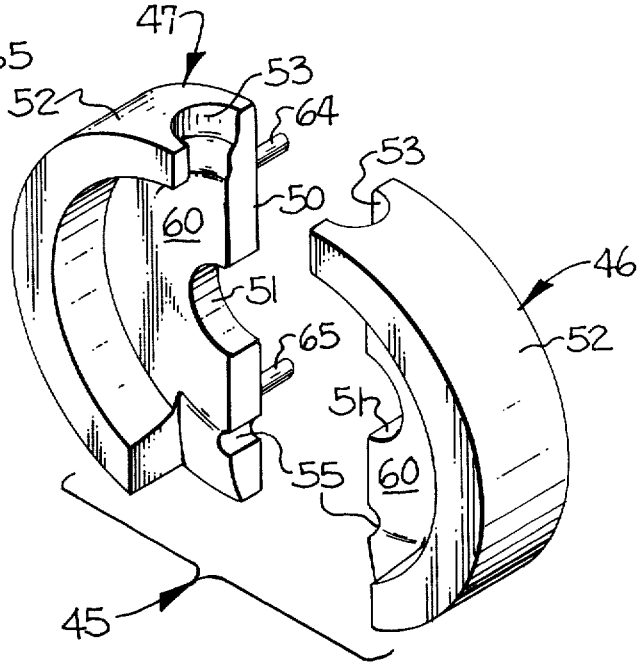
FIG. 3 is another perspective view of the cooperating pair of blocks of FIG. 2, but showing the blocks in solid lines, and looking at the opposite side thereof from that shown in FIGS. 1 and 2.
Figure 4:
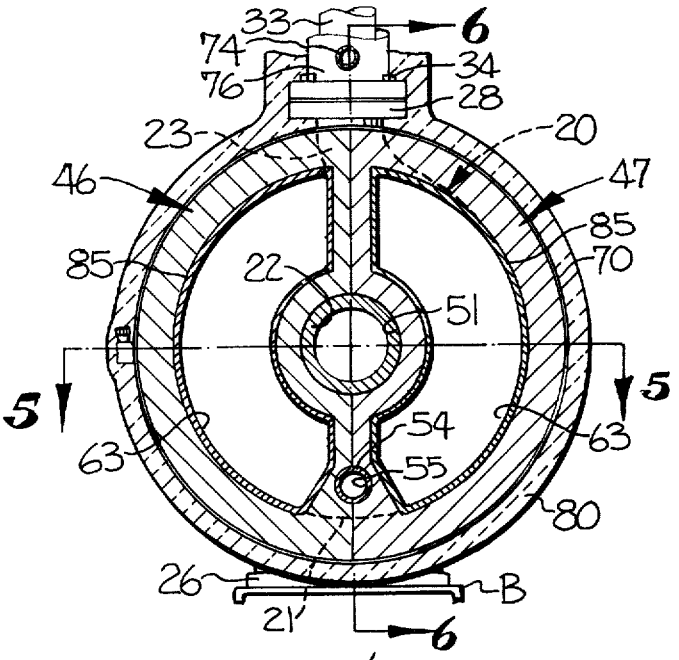
FIG. 4 is an enlarged vertical sectional view through the jacket mounted on the pump as in FIG. 1, but illustrating the two hollow members or radiators defining the fluid passageways within the respective jacket blocks, and also wherein an insulation material is shown in cross-section surrounding the jacket construction.
Figure 5:
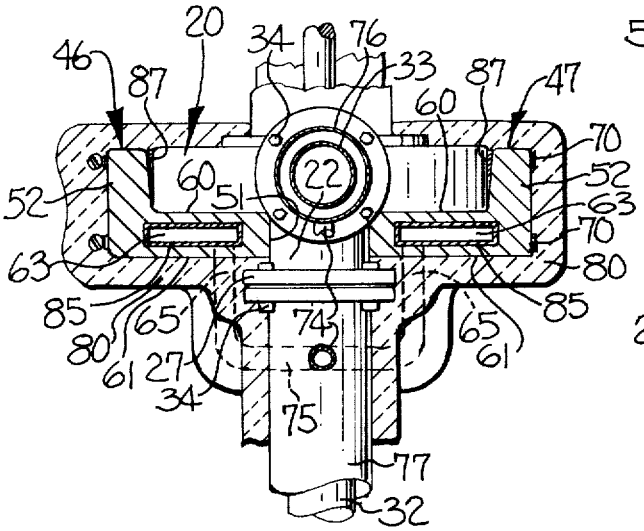
FIG. 5 is a fragmentary sectional plan view taken substantially along line 5—5 in FIG. 4 and wherein a heat-conductive filler is shown between the jacket housing and the pump body.
Figure 6:
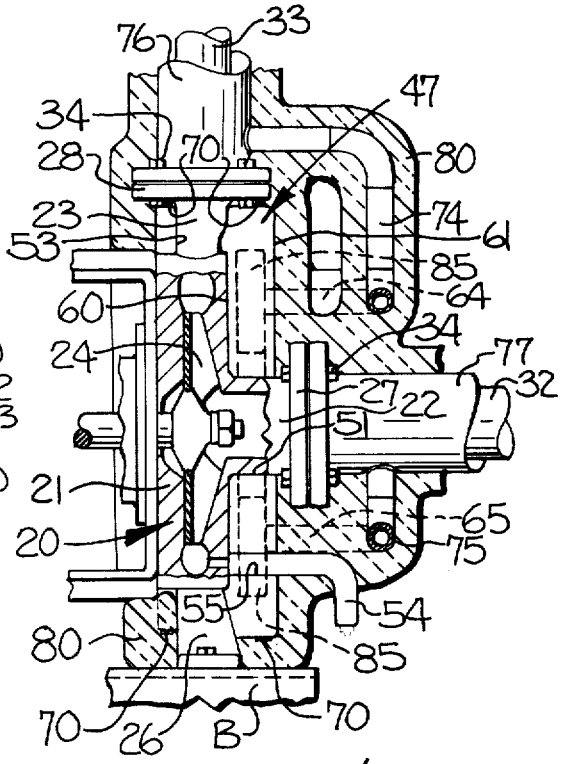
FIG. 6 is a fragmentary vertical sectional view through the pump and the surrounding jacket construction taken substantially along line 6—6 in FIG. 4.

Referring more specifically to the drawings, the first embodiment of the invention is shown in FIGS. 1–6 in association with a fluid conveying system including a pump which appears only in FIGS. 4, 5 and 6 and is broadly designated at 20. In this embodiment of the invention, the associated pump 20 is shown in the form of a typical end-suction centrifugal pump whose body or casing 21 is of volute form and is provided with a projecting axial inlet portion 22 and a substantially radial outlet portion 23 substantially normal to the inlet portion 22. As shown, the inlet portion 22 extends in a substantially horizontal position and the outlet portion 23 extends upwardly in a substantially vertical position in FIG. 6.

Pump body 21 has a suitable rotary impeller means 24 therein (FIG. 6) which is driven by a suitable motive means 25 to rotate about an axis substantially aligned with inlet portion 22, as is conventional. Typically, the axis of outlet portion 23 substantially intersects the axis of inlet portion 22 and impeller means 24. However, such relationship between inlet portion 22, outlet portion 23 and impeller means 24 is not essential to the invention. The particular pump 20 (shown in FIGS. 4, 5 and 6) also has a supporting member 26 projecting downwardly from pump body 21 and resting upon a suitable base B upon which motive means 25 also is supported.

To accommodate adjacent connecting elements of the fluid conveying system, the inlet and outlet portions 22, 23 of pump body 21 project outwardly and have respective enlarged flanges 27, 28 thereon. In this instance, the fluid conveying system includes jacketed inlet and outlet pipes or conduits 32, 33 whose flanged proximal ends are suitably secured, as by bolts 34, to the outer surfaces of flanges 27, 28 of the respective inlet and outlet portions 22, 23 of pump 20. It is apparent that, during operation of pump 20, impeller means 24 draws a processing fluid through inlet conduit 32 and into the pump body 21 while propelling and discharging the fluid outwardly through the outlet portion 23 and conduit 33.

In the handling of many processing materials in the fluid state, it is necessary to maintain such materials within a critical temperature range which may be cold, temperature or hot, depending upon the individual characteristics of the processing fluid. Therefore, in order to maintain the pump and especially the fluid being pumped thereby at a desired predetermined temperature, in accordance with the invention, a jacket construction substantially surrounds the body 21 of pump 20 in heat-transferring relation thereto and cooperates with pump 20 for directing a temperature controlling fluid into heat-transferring relation thereto. According to this embodiment of the invention, such jacket construction is in the form of a composite housing broadly designated at 45 which is of heat-conductive material and preferably is molded or cast from an aluminum alloy in this instance. Housing 45 comprises a cooperating pair of generally semicircular jacket blocks 46, 47 which are of semicircular configuration because of the substantially circular configuration of the major portion of the volute body 21 of pump 20.

Thus, as shown, the cooperating pair of jacket blocks 46, 47 are collectively of substantially circular, cup-shaped configuration. However, the housing 45 may be of polygonal exterior configuration, if desired, without departing from the invention (see FIGS. 9, 10 and 12, for example). It is apparent that the pair of blocks 46, 47 also are collectively of substantially U-shaped cross-sectional configuration in plan (FIG. 5).

Figure 1:
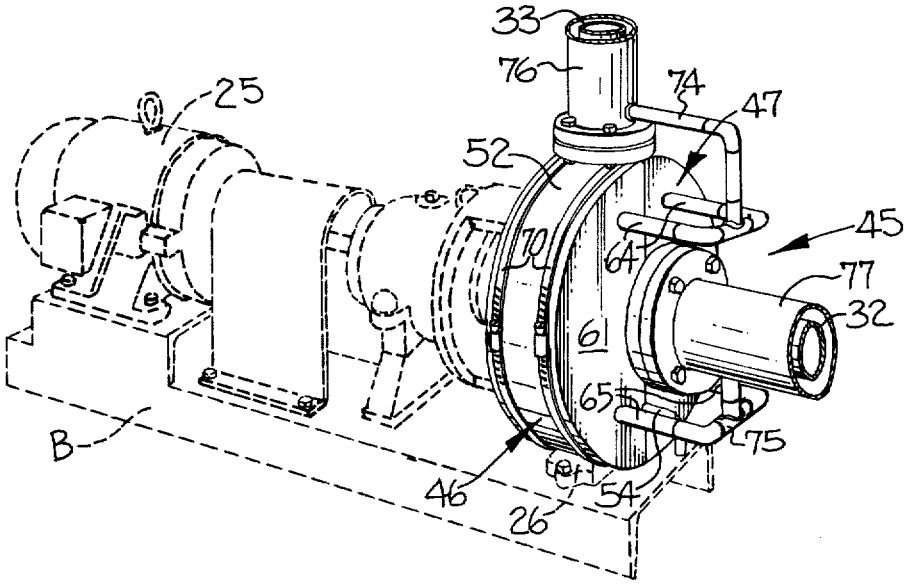

Each of the jacket blocks 46, 47 is shown as comprising a substantially semicircular body 50 so that the proximal diametrical surface portions of blocks 46, 47 may abut each other substantially as shown in FIGS. 1 and 4. Also, each of the jacket bodies 50 is provided with a substantially semicircular opening 51 extending substantially axially therethrough which is adapted to fit in closely surrounding and heat-transferring relation to the respective half of pump inlet portion 22 when the jacket blocks 46, 47 are properly installed, as best shown in FIGS. 4, 5 and 6.

The peripheral portions of the substantially semicircular bodies 50 of the cooperating jacket blocks 46, 47 have respective arcuate axially projecting wall members 52 integral therewith which are positioned radially of impeller means 24 and whose portions adjacent outlet portion 23 are substantially flush with the substantially diametrical surfaces of the respective bodies 50. The proximal upper portions of arcuate wall members 52 are provided with respective substantially semicircular passageway 53 therethrough adapted to collectively closely surround the pump outlet portion 23 in heat-transferring relation thereto.

The arcuate wall members 52 of the two jacket blocks 46, 47 collectively substantially encirclingly engage the volute body 21 of pump 20, with the exception that the lower portions of the arcuate wall members 52 are cut away or recessed, as shown in the lower portion of FIG. 3, so as to straddle the supporting member 26 projecting downwardly from the lower portion of pump body 21 and resting upon base B. It is apparent, therefore, that the lower proximal portions of the bodies 50 of blocks 46, 47 extend inwardly toward each other beyond the terminal lower portions of the arcuate wall members 52. Since the lower portion of pump 20 is shown provided with a normally closed drainage duct or conduit 54 projecting outwardly therefrom (FIG. 6), it will be observed in FIGS. 2, 3 and 4 that the lower portions of the substantially diametrical surfaces of the bodies 50 of blocks 46, 47 are provided with respective substantially semicircular openings 55 therethrough, which are substantially smaller than the openings 51, so as to accommodate the drainage duct 54 therethrough.

Now, by referring to FIG. 5, it will be apparent that each block 46, 47 includes inner and outer walls 60, 61 having therebetween a fluid passageway or chamber 63 provided with inlet and outlet ports 64, 65. These inlet and outlet ports 64, 65 are provided to facilitate circulation of a temperature controlling fluid through the respective passageways 63. Since those surfaces of the inner walls 61 and the arcuate wall members 52 of the jacket blocks 46, 47 substantially conform to the shape of the volute body 21 of centrifugal pump 20, it can be appreciated that the temperature controlling fluid in passageways 63 is directed into heat-transferring relation to the pump body 21.

In this regard, it should be noted that the proximal diametrical surfaces of the bodies 50 of jacket blocks 46, 47 are held in substantially abutting relationship and the blocks 46, 47 are urged toward and into close proximity to, or against, the diametrically opposed sides of the pump body 21 by any suitable means, which preferably is a detachable means, facilitating detachably securing the pair of blocks 46, 47 on pump body 21. By way of example, it will be observed in FIGS. 1, 3 and 4 that suitable adjustable strapping 70 is secured around the two jacket blocks 46, 47 for securing the same on pump body 21.

In order to circulate the aforementioned temperature controlling fluid through each passageway 63, it will be observed that inlet and outlet ports 64, 65 are in the form of tubular members projecting from blocks 46, 47 and having corresponding ends of conduit means 74, 75 connected thereto, with the opposite ends thereof being communicatively connected to respective jacketing tubes 76, 77 surrounding the respective outlet and inlet conduits 33, 32 of the fluid conveying system.

It is to be noted that the flanged conduits 32, 33 and the respective jacketing tubes 77, 76 are representative of typical jacketed pipes employed in conventional jacketed fluid conveying systems with a suitable temperature controlling fluid being circulated through the fluid-circulating chambers defined between the conduits 32, 33 and the respective jacketing tubes 77, 76. In this instance, the temperature controlling fluid preferably is circulated from the jacketing tube 76 into the jacketing tube 77 therebelow and, accordingly, it is apparent that the temperature controlling fluid is circulated from the upper jacketing tube 76, through the inlet ports 64, through the respective fluid-circulating passageways 63, and through the outlet ports 65 into the jacketing tube 77.

Of course, if desired, the temperature controlling fluid may be circulated in the reverse direction through the respective passageways 63, in the pump jacket blocks 46, 47. It is apparent that the temperature controlling fluid may take various forms depending upon the particular type of fluid being conveyed through the fluid conveying system embodied in the pipes or conduits 32, 33. For example, the temperature controlling fluid being circulated through passageways 63 may take the form of steam, oil, water, refrigerant or the like. After the housing 45 has been assembled with the pump 20 in the manner described with respect to FIGS. 1, 4, 5 and 6, a suitable, preferably relatively thick, layer of insulation material 80 preferably is applied to the exterior surfaces of housing 45, pump flanges 27, 28, the conduit means 74, 75 and jacketing tubes 76, 77 as indicated in FIGS. 4, 5 and 6.

As heretofore indicated, at least the body 50 of each jacket block 46, 47 is provided with inner and outer walls 60, 61 (FIGS. 3 and 5) having therebetween the respective fluid passageway or chamber 63. As shown in FIGS. 2, 4, 5 and 6, each block 46, 47 is provided with a substantially semicircular or crescent-shaped hollow member or radiator 85 which is preferably formed of relatively thin steel sheet material and defines therein the respective fluid passageway or chamber 63 to which the conduit means forming inlet and outlet ports 64, 65 are connected, as by welding. It is to be understood, however, that the hollow members or radiators 85 may be omitted from the passageways or chambers 63 so that the inner and outer walls 60, 61 per se define the corresponding passageway 63 therebetween. Of course, in the absence of the hollow members or radiators 85, it is apparent that the inner ends of the conduits defining the inlet and outlet ports 64, 65 then would be threaded into or otherwise secured to blocks 46, 47 for communication with the passageways 63.

As heretofore indicated, it is preferred that the jacket blocks 46, 47 are of cast metal. Accordingly, when the hollow members or radiators 85 are employed, as best shown in FIGS. 4, 5 and 6, it is preferred that the cast metal is in the form of an aluminum alloy since it has a very high heat conductivity characteristic. Because of the brittle or frangible nature of the usual type of cast aluminum alloy, it is preferred that radiators 85 are used when the blocks 46, 47 are molded of aluminum alloy. On the other hand, if blocks 46, 47 are molded of cast steel, which is substantially stronger than cast aluminum, the hollow members 85 may be omitted, if desired.

Although passageways 63 are only shown provided in the substantially semicircular bodies 50 of the jacket blocks 46, 47, it is to be understood that such passageways may extend into the substantially arcuate walls 52 of the respective jacket blocks 46, 47, if desired, without departing from the invention. To further enhance the heat-transferring relationship between pump body 21 and jacket blocks 46, 47, it is preferred that a suitable heat-conductive filler 87, such as heat-conductive cement or heat-conductive grease (FIG. 5), is provided between pump body 21 and jacket blocks 46, 47 so as to fill voids which might otherwise be present between the proximal surfaces of jacket blocks 46, 47 and pump body 21. Various formulations of heat-conductive cement and grease for the purpose of enhancing heat transfer are well known in the trade and in the art. Thus, a further description thereof is deemed unnecessary.

Referring now to the second embodiment of the invention shown in FIGS. 7–12, it will be observed that the structure there shown is quite similar to that shown in FIGS. 1–6, but the jacket blocks are modified to particularly adapt the same to a fluid-circulating pump of the in-line, pedestal mounted type having its motive means or driving motor 25*a* mounted on the top of the pump body for driving the rotary impeller means 24*a* therein. Also, somewhat different means are provided for detachably securing the jacket blocks of FIGS. 8–12 to the pump body of FIG. 7 as compared to the strapping 70 shown in FIGS. 1, 4 and 5. However, those parts shown in FIGS. 7–12 which are generally similar to parts shown in FIGS. 1–6 will bear the same reference characters, where applicable, with the letter "*a*" added to avoid repetitive description, and only those parts of the structure shown in FIGS. 7–12 which have particularly significant differences from similar parts shown in FIGS. 1–6 will be described in detail.

As is characteristic of an "in-line" fluid-circulating pump, the flanged inlet portion 32*a* and flanged outlet portion 33*a* of the body 21*a* of pump 20*a* (FIG. 7) are in substantially axial alignment with each other and they are arranged in substantially horizontal relationship, with impeller means 24*a* being mounted on a substantially vertical axis in pump body 21*a*. Thus, impeller motive means 25*a* is suitably secured upon pump body 21*a*, and pump body 21*a* has a supporting pedestal 26*a* integral with the lower portion thereof and provided with an integral supporting flange 29 on its bottom portion adapted to rest upon a floor or other supporting surface. Thus, it can be seen that the lower portion of pump body 21*a* in FIG. 7 terminates in a reduced portion, represented by pedestal 26*a*, which is of substantially smaller cross-sectional area than the major or upper portion of pump body 21*a*. Also, the supporting flange 29 is, therefore, attached to the reduced portion of pump body 21*a* and is of substantially greater area in plan than the cross-sectional area of the reduced portion 26*a* of pump body 21*a*. For convenience in installing the pair of jacket blocks 46*a*, 47*a* about the pump body 21*a* of FIG. 7, desirably the jacket blocks 46*a*, 47*a* of FIGS. 8–12 are constructed so as to rest upon the supporting flange 29 of pump 28.

Figure 9:
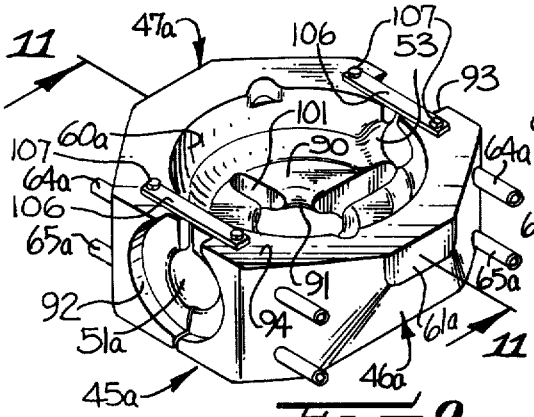
FIG. 9 is an enlarged perspective view of the second embodiment of the cooperating pair of blocks collectively forming the pump jacket construction of FIG. 8, but with the blocks removed from the pump body.
Figure 10:
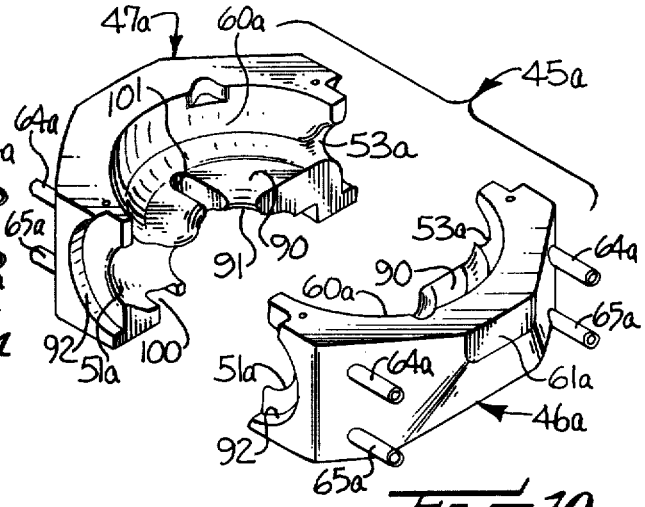
FIG. 10 is a perspective view of the jacket blocks of FIG. 9 but showing the same in exploded relationship.
Figure 11:
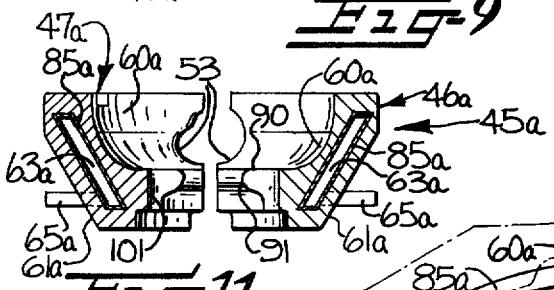
FIG. 11 is a transverse vertical sectional view through the two jacket blocks taken substantially along line 11—11 in FIG. 9.

From the foregoing description of the pump 20*a* of FIG. 7, it can be appreciated that the substantially circular or convex openings 51*a*, 53*a* formed in the proximal edge portions of jacket blocks 46*a*, 47*a* are both formed in end wall portions of blocks 46*a*, 47*a* so that the openings 51*a*, 53*a* are in substantial alignment with each other as opposed to the openings 51, 53 of FIG. 2 being disposed in substantially perpendicular relation to each other. The proximal portions of the jacket blocks 46*a*, 47*a* are shown in FIGS. 9 and 10 as being provided with generally arcuately formed recesses therein terminating in respective inwardly projecting ridge portions or bottom wall portions 90 which are formed so as to underlie the upper portion of the pump body in closely circumscribing relation to the reduced lower portion or pedestal 26*a* of pump body 21*a*. The medial portions of the ridge portions 90 of blocks 46*a*, 47*a* are recessed at 91 to provide an opening through housing 45*a* for accommodating the reduced portion 26*a* of pump 20*a* at the juncture of supporting flange 29. It can be appreciated that, when the jacket blocks 46*a*, 47*a* are positioned about the body 21*a* of pump 20*a*, they are collectively of a substantially cup-shaped configuration and are collectively substantially U-shaped in cross-section as best shown in FIGS. 9 and 11. It will be noted that, in addition to the arcuate or concave openings 51*a*, 53*a* being provided in opposite ends of the jacket blocks 46*a*, 47*a*, such opposite ends are also provided with flange-accommodating arcuate recesses 92, 93 in the outer surfaces thereof which are of substantially greater size than the arcuate openings 51*a*, 53*a* and are adapted to receive therein the flanges 27*a*, 28*a* on the distal ends of the inlet and outlet portions 22*a*, 23*a* of pump 20*a*. It is preferred that the depth of each recess 92, 93 is such as to accommodate the heads of other portions of bolts utilized for securing the flanged ends of the adjacent conduits 32*a*, 33*a* to the respective flanges 27*a*, 28*a*.

Figure 12:
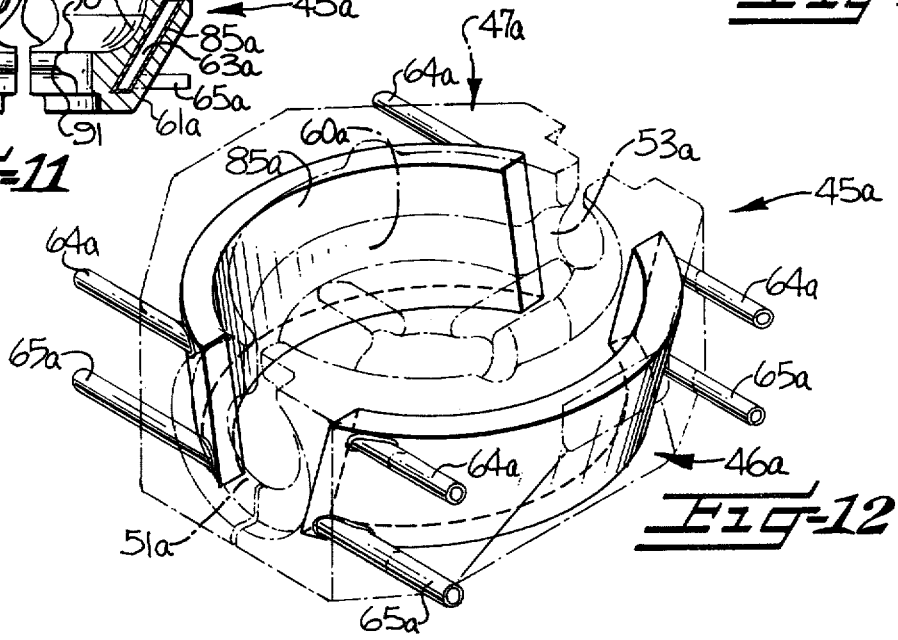
FIG. 12 is an enlarged view somewhat similar to FIG. 9, but showing the jacket blocks in phantom or broken lines to illustrate in solid lines therein a respective pair of hollow shell-like members or radiators defining the fluid passageways in the cooperating pair of blocks.

Instead of the projecting ridge portions or lower wall portions 90 of the blocks 46*a*, 47*a* being provided with the fluid-circulating passageways therein, similar to the bodies 50 of the jacket blocks 46, 47 in the first embodiment of the invention, it will be observed in FIGS. 9, 10 and 12 that the inner and outer walls 60*a*, 61*a* of jacket blocks 46*a*, 47*a* in the second embodiment of the invention are parts of an upstanding body portion 94 of each respective jacket block 46*a*, 47*a*. The body portions 94 straddle and extend along opposite sides of the pump body 21*a* between the flanges 27*a*, 28*a*, with the flanges 27*a*, 28*a* being positioned within the recesses 92, 93 as indicated above.

The body portions 94 include the aforementioned inner and outer walls 60*a*, 61*a* which correspond substantially to the inner and outer walls 60, 61 of FIG. 5, and have respective arcuate passageways or chambers therebetween which are defined by the arcuate hollow shell-like members or radiators 85*a* shown in FIGS. 11 and 12. It is apparent that the jacket blocks 46*a*, 47*a* are molded or cast around the respective hollow members 85*a* of FIG. 12 in substantially the manner heretofore described with respect to the jacket blocks 46, 47 being molded or cast around the hollow shell-like members 85 in FIGS. 2, 4, 5 and 6. Also, the inner surfaces of blocks 46*a*, 47*a* are shaped to conform substantially to the configuration of pump body 21*a*.

Referring again to FIG. 7, as is preferred, the supporting flange 29 forming the bottom of pump 20*a* is secured to the supporting surface or floor therebeneath by suitable screws or bolts 95 whose heads project upwardly above the upper surface of the supporting flange 29. Additionally, a substantially vertically disposed rib 96 projects outwardly from each side of the pedestal 26*a* of pump 20*a* and extends from the upper portion of pump body 21*a* downwardly to the supporting flange 29. Accordingly, the inwardly projecting ridge or bottom wall portions 90 of jacket blocks 46*a*, 47*a* are provided with respective pairs of spaced grooves or recesses 100 in the lower surfaces thereof for accommodating the heads of the bolts 95 when the blocks 46*a*, 47*a* are positioned upon the supporting flange 29 of FIG. 7. Further, each of the ridge portions or bottom wall portions 90 of the blocks 46*a*, 47*a* is provided with a laterally extending slot 101 therethrough for accommodating therein the respective rib portion 96 of the pump 20*a*.

It will be observed in FIGS. 9, 10 and 12 that each of the jacket blocks 46*a*, 47*a* has two of the inlet ports 64*a* and two of the outlet ports 65*a* projecting outwardly therefrom, thee being one pair of the ports 64*a*, 65*a* disposed at one end of each block 46*a*, 47*a* and there being another pair of the ports 64*a*, 65*a* projecting outwardly from the other end portion of each block 46*a*, 47*a*. However, it is to be noted that two sets of the ports 64*a*, 65*a* are provided on each block 46*a*, 47*a* for convenience in installation of the blocks 46*a*, 47*a* and the connection thereto of the conduit means 74*a*, 75*a* from the respective jacket tubes 77*a*, 76*a* to the blocks 46*a*, 47*a*. In other words, only a single pair of the ports 64*a*, 65*a* is necessary for each of the hollow shell-like members 85*a*, with the other pair of ports then being closed by any suitable means, such as pipe plugs, not shown.

Figure 8:
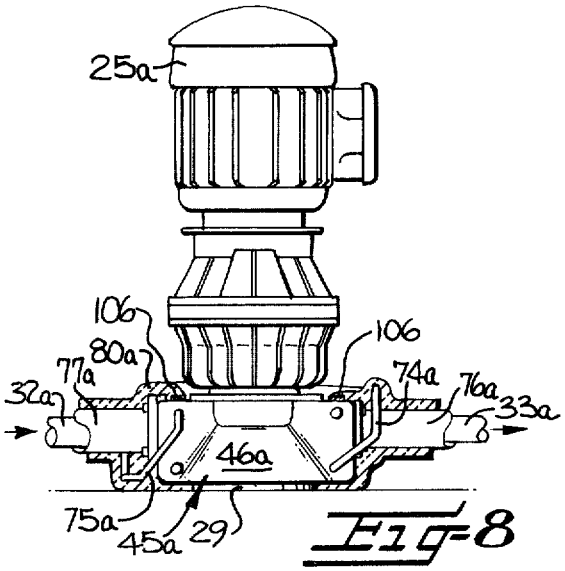
FIG. 8 is a very similar to FIG. 7 showing a second embodiment of the improved jacket construction in heat-transferring relation to the body of the pump and showing insulation material around the pump and its jacket construction.

As preferred, the upper surfaces of the body portions 94 of the blocks 46*a*, 47*a* are preferably substantially flat and are disposed on a level substantially the same as the upper surface of the pump 20*a* when the jacket blocks 46*a*, 47*a* are installed against opposite sides of pump body 21*a* as shown in FIG. 8. Thus, the jacket blocks 46*a*, 47*a* are secured in position against opposite sides of pump body 21*a* by means of suitable links 106 which are secured to the upper ends of the body portions 94 of the jacket blocks 46*a*, 47*a* by means of screws 107 (FIG. 9), and if desired, links 106 may engage and rest upon adjacent portions of the body 21*a* of pump 20*a* to position jacket blocks 46*a*, 47*a* in the desired substantially surrounding relation to pump body 21*a*.

Since, in other respects, the embodiment of the invention of FIGS. 7–12 is quite similar to that of FIGS. 1–6, a further description of the embodiment of FIGS. 7–12 is deemed unnecessary. It should be noted, however, that a filler corresponding to that indicated at 87 in FIG. 5 should be utilized as needed to fill any voids between the proximal surfaces of jacket housing 45*a* and pump 20*a* to facilitate the transfer of heat therebetween.

Referring now to FIGS. 13–17, there is illustrated a third embodiment of the invention wherein the pump is of substantially the same type as that illustrated and described with respect to FIG. 7, with the exception that the pump of FIGS. 13, 14, 16 and 17 is of a type which may be suspendingly supported between adjacent conduits or pipes of the fluid conveying system and, therefore, the pump in the latter views is devoid of any supporting flange below the pump body. The pump jacket construction shown in FIGS. 13–17 differs primarily from that shown in FIGS. 7–12 in that the opposing sides of the jacket construction are integral with each other through the medium of a bridging portion therebetween so that the jacket housing 45*a*′ of FIGS. 13–17 is of substantially U-shaped cross-section throughout its length although being more deeply recessed in its medial portion that in its opposite end portions to accommodate therein the protruding lower portion of the respective pump. In other respects, the structure shown in FIGS. 13–17 is similar to that described with respect to FIGS. 7–12 and, therefore, the same reference characters shall apply to those parts shown in FIGS. 13–17 as are applied to similar parts shown in FIGS. 7–12 with the prime notation added, where applicable, in order to avoid repetitive description.

The substantially U-shaped housing 45*a*′ is in the form of a single integral block cast or molded from a suitable heat-conductive material. Since block 45*a*′ is of substantially U-shaped cross-section, it includes opposing leg or side portions 46*a*′, 47*a*′ interconnected by the bridging portion. The side portions 46*a*′, 47*a*′ and the bridging portion define therewithin an irregularly-shaped cavity 110 of generally U-shaped cross-sectional configuration, but which is reduced at opposite ends of the jacket block 45*a*′ to define respective substantially U-shaped inlet and outlet openings 51*a*′, 53*a*′ therewith through which the inlet and outlet portions 22*a*′, 23*a*′ of pump 20*a*′ extend. Also, oppostie end portions of the U-shaped housing or jacket block 45*a*′ are provided with respective enlarged substantially U-shaped recesses 92′, 93′ therein for accommodating therein the respective inlet and outlet flanges 27*a*′, 28*a*′ of pump 20*a*′.

The upper portion of the body 21*a*′ of pump 20*a*′ is of generally scalloped configuration at its juncture with motive means 25*a*′. Therefore, it will be observed in FIG. 15 that the upper portion of the cavity 110 is provided with recesses 112 therearound to accommodate generally circularly arranged peripheral projections 113 on the upper portion of pump body 21*a* and the lower portion of motive means 25*a*′ (FIGS. 13 and 14). Links 106′ and screws 107′ secure the substantially U-shaped housing 45*a*′ to pump body 21*a*′ in substantially the same manner as that described with respect to the second embodiment of the invention.

It will be observed in FIG. 16 that, since housing 45*a*′ is of substantially U-shaped configuration, it is provided with a generally U-shaped chamber or passageway 63*a*′ located between the inner and outer walls thereof, and passageway 63*a*′ extends along the lower bridging portion of housing 45*a*′ as well as extending upwardly along both leg portions 46*a*′, 47*a*′. Thus, passageway 63*a*′ extends beneath and along opposite sides of pump body 21*a*′. Passageway 63*a*′ is provided with inlet and outlet ports 64*a*′, 65*a*′ for circulation of temperature controlling fluid therethrough. If desired, housing 45*a*′ may be molded or cast around a hollow shell-like member or radiator 85*a*′, whose sheet metal walls define passageway or chamber 63*a*′ in housing 45*a*′. In other respects, the third embodiment of the invention is similar to the first and second embodiments of the invention, and accordingly, a further description thereof is deem unnecessary. It will be observed in FIG. 17, however, that the spaces over the inlet and outlet portions 22*a*′, 23*a*′ of the body 21*a* of pump 20*a*′ and between the opposing walls of the openings 51*a*′, 53*a*′ preferably are filled with a heat-conductive filler 87*a*′ of the type identified at 87 in FIG. 5 so as to aid in transfer of heat between housing 45*a*′ and the inlet and outlet portions 22*a*′, 23*a*′ of pump 20*a*′.

From the foregoing description, it can be appreciated that the jacket construction of this invention may take various forms in accordance with the particular type and exterior configuration of the fluid-circulating pump with which the jacket construction is used and so that the jacket construction substantially surrounds the body of the pump in heat-transferring relation thereto for directing a temperature controlling fluid into heat-transferring relation to the pump body without the need for welding any portions of the jacket construction to the pump. In this regard, in the pumping of a melted synthetic plastic material, for example, such as melted polyethylene or polypropylene, in the manufacture of synthetic textile strands, it has been found that the efficiency of operation of the pump was increased up to about 15% by utilizing the jacket construction of this invention in association with the pump in the manner described herein, as compared to the operation of the pump without a jacket construction for a temperature controlling fluid being applied thereto. It also has been determined that, because of the highly effective heat-transferring relation between the pump body and the improved jacket construction of this invention, the efficiency of the pump is improved substantially as compared to the efficiency thereof as effected by use of a jacket wall structure welded to a pump body according to the heretofore customary practice discussed earlier herein.

It is thus seen that I have provided several forms of an improved jacket construction to aid in maintaining at a desired temperature a fluid flowing through a fluid-circulating pump in a fluid conveying system and wherein the jacket construction is simple and may be readily installed on existing fluid-circulating pumps even though the existing pumps may be already installed in a fluid conveying system. Further, the jacket construction may be readily removed from a fluid-circulating pump at any time, if desired, to permit repairing or replacing a fluid-circulating pump or the performance of any other corrective work which may be desired in connection therewith, after which the jacket construction may be reinstalled on the corresponding fluid-circulating pump.

In the drawings and specification, there have been set forth preferred embodiments of the invention, and although specific terms are employed, they are used in a generic and descriptive sense only and not for purposes of limitation.

That which is claimed is:

1. In a fluid-circulating pump of the in-line type having a body provided with inlet and outlet portions projecting outwardly at opposite ends of the body, and impeller means in said body for pumping fluid therethrough; the combination therewith of means substantially surrounding said pump body and outwardly projecting inlet and outlet portions in heat-transferring relation thereto and cooperating with said pump for directing a temperature controlling fluid in heat-transferring relation thereto and comprising a housing of heat-conductive material including inner and outer walls having therebetween at least one fluid passageway provided with inlet and outlet ports for circulation of the temperature controlling fluid through said passageway.

2. A structure according to claim 1 including a heat-conductive filler disposed between and filling voids between the proximal surfaces of said housing and the pump to facilitate the transfer of heat therebetween.

3. A structure according to claim 1 including a hollow shell-like member of heat-conductive material defining said fluid passageway in the housing, and said walls of said housing being molded around said hollow shell-like member.

4. A structure according to claim 1 including a hollow member of relatively thin heat-conductive material defining said fluid passageway in the housing, and said walls of the housing being of aluminum alloy molded around said hollow member.

5. A structure according to claim 1, wherein said housing comprises a cooperating pair of blocks with each block including inner and outer walls having a respective fluid passageway therebetween.

6. A structure according to claim 1 wherein said housing comprises a single integral block having wall portions extending along opposite sides of the body of the pump, with said fluid passageway being within said wall portions.

7. A structure according to claim 1 wherein said housing is substantially U-shaped in cross-section.

8. A structure according to claim 1 wherein said fluid passageway in the housing is substantially U-shaped in cross-section and extends beneath and adjacent opposite sides of the body of the pump.

9. A structure to claim 1 wherein said housing comprises a single integral block having a recessed medial portion in which the pump body is positioned, and wherein said passageway in the housing is substantially U-shaped in cross-section and extends beneath and adjacent opposite sides of the body of the pump.

10. In a fluid-circulating pump of the centrifugal type having a body of volute form provided with outwardly projecting inlet and outlet portions, impeller means in said body for pumping fluid therethrough, and wherein said inlet portion projects outwardly axially of said impeller means, and said outlet portion projects outwardly substantially radially of said impeller means; the combination therewith of means substantially surrounding said pump body and said outwardly projecting inlet and outlet portions in heat-transferring relation thereto and cooperating with said pump for directing a temperature controlling fluid in heat-transferring relation thereto and comprising a housing of heat-conductive material including inner and outer walls having therebetween at least one fluid passageway provided with inlet and outlet ports for circulation of the temperature controlling fluid through said passageway.

11. A structure according to claim 10 wherein said housing inner wall is positioned against said volute pump body axially of said impeller means, and said housing also including an arcuate wall at least partially surrounding said volute pump body radially of said impeller means.

12. A structure according to claim 10 wherein said housing is of generally cup-shaped configuration with said housing inner wall defining one end of the cup-shaped configuration and being positioned against said volute pump body axially of said impeller means, said housing also including an arcuate wall at least partially surrounding said volute pump body radially of said impeller means, and the housing being open at its other end.

13. In a fluid-circulating pump having a body provided with inlet and outlet portions, and impeller means in said body for pumping fluid therethrough; the combination therewith of means substantially surrounding said pump body in heat-transferring relation thereto and cooperating with said pump for directing a temperature controlling fluid in heat-transferring relation thereto and comprising a housing formed of a pair of blocks of heat-conductive material, each block including inner and outer walls having therebetween a fluid passageway provided with inlet and outlet ports for circulation of the temperature controlling fluid through said passageway.

14. In a fluid-circulating pump having a body provided with inlet and outlet portions, and rotary impeller means in said body for pumping fluid therethrough; the combination therewith of means substantially surrounding said pump body in heat-transferring relation thereto and cooperating with said pump for directing a temperature controlling fluid into heat-transferring relation thereto and comprising a housing including a cooperating pair of blocks of heat-conductive material, each block including inner and outer walls having therebetween a fluid passageway provided with inlet and outlet ports for circulation of the temperature controlling fluid through the passageway, and means associated with said pair of blocks for positioning the same in predetermined relation to each other and in substantially surrounding relation to said pump body.

15. A structure according to claim 14 including a heat-conductive filler disposed between and filling voids between the proximal surfaces of said housing and said pump to facilitate the transfer of heat therebetween.

16. A structure according to claim 14 wherein said means associated with said pair of blocks for positioning the same in predetermined relation and in substantially surrounding relation to said pump body comprises means for detachably securing said pair of blocks on said pump body.

17. A structure according to claim 14 wherein said pump is adapted to occupy a substantially horizontal position with said inlet and outlet portions of said pump body being at opposite ends of the pump body and in substantial alignment with each other, the lower portion of the pump body terminating in a reduced portion of substantially smaller cross-sectional area than the upper portion thereof, a supporting flange attached to the bottom of said reduced portion of the pump, and the proximal lower portions of the pair of blocks of said housing having inwardly projecting portions thereon underlying the upper portion of the pump body and closely circumscribing said reduced lower portion of the pump body in heat-transferring relation thereto.

18. In a fluid-circulating pump having a body provided with inlet and outlet portions thereon, and rotary impeller means in said body for pumping fluid therethrough; the combination therewith of means substantially surrounding said pump body in heat-transferring relation thereto and cooperating with said pump for directing a temperature controlling fluid into heat-transferring relation thereto and comprising a housing including a cooperating pair of blocks of heat-conductive material, and each block including inner and outer wall means having therebetween a fluid passageway provided with inlet and outlet ports for circulation of the temperature controlling fluid through the passageway, means associated with said pair of blocks for positioning the same in predetermined relation to each other and in substantially surrounding relation to said pump body, and a layer of insulation material substantially enclosing said housing and said pump body.

19. In a fluid-circulating pump of the in-line type having a body provided with inlet and outlet portions projecting outwardly at opposite ends of the pump body and having enlarged end flanges on the distal ends thereof, and impeller means in said body for pumping fluid therethrough; the combination therewith of means substantially surrounding said pump body in heat-transferring relation thereto and cooperating with said pump for directing a temperature controlling fluid in heat-transferring relation thereto and comprising a housing of heat-conductive material including inner and outer walls having therebetween at least one fluid passageway provided with inlet and outlet ports for circulation of the temperature controlling fluid through said passageway, said housing being provided with openings therein closely surrounding the projecting inlet and outlet portions of the pump body, and said housing also being provided with recesses therein for accommodating therein the flanges on the projecting inlet and outlet portions of the pump.

* * * * *

UNITED STATES PATENT AND TRADEMARK OFFICE

CERTIFICATE OF CORRECTION

PATENT NO. : 3,936,220

DATED : February 3, 1976

INVENTOR(S) : James R. Henderson

It is certified that error appears in the above-identified patent and that said Letters Patent are hereby corrected as shown below:

Column 4, Line 27, "temperature" should be --temperate--. Column 9, Line 6, "thee" should be --there--; same column, Line 61, "that" should be --than--. Column 10, Line 15, change "oppostie" to --opposite--. Column 12, Line 16, CLAIM 9, after "structure" insert --according--.

Signed and Sealed this

*fourth* Day of *May 1976*

[SEAL]

*Attest:*

RUTH C. MASON
*Attesting Officer*

C. MARSHALL DANN
*Commissioner of Patents and Trademarks*